United States Patent [19]

Conti

[11] Patent Number: 4,575,121

[45] Date of Patent: Mar. 11, 1986

[54] POSTAL MODULE FOR CONFIDENTIAL INFORMATION

[76] Inventor: Romano Conti, 37, Via Pier della Francesca, I-50047 Prato (Florence), Italy

[21] Appl. No.: 551,607

[22] Filed: Nov. 14, 1983

[30] Foreign Application Priority Data

Nov. 25, 1982 [IT] Italy ..... 9552 A/82

[51] Int. Cl.[4] ..... B41L 1/20; B42D 1/00; B65D 27/00; B65D 27/10

[52] U.S. Cl. ..... 281/2; 282/25; 281/38; 229/92.3; 229/69

[58] Field of Search ..... 281/1 R, 2, 5, 21 R, 281/47; 206/608, 610; 282/11.5 R, 22 R, 25, 18, 11.5 A; 229/69, 73, 79, 92.1, 92.3

[56] References Cited

U.S. PATENT DOCUMENTS

| | | | |
|---|---|---|---|
| 1,424,837 | 8/1922 | Lover | 282/25 |
| 1,794,223 | 2/1931 | Zabek | 229/92.3 |
| 3,162,116 | 12/1964 | Weber | 282/11.5 A |
| 3,255,952 | 6/1966 | Black | 229/73 |
| 3,428,237 | 2/1969 | Dowen | 229/69 |
| 3,718,277 | 2/1973 | Volkert | 283/56 |
| 3,920,267 | 11/1975 | Lyon, Jr. | 281/5 |
| 4,380,315 | 4/1983 | Steidinger | 282/11.5 A |
| 4,418,865 | 12/1983 | Bowen | 282/11.5 A |

FOREIGN PATENT DOCUMENTS

| | | | |
|---|---|---|---|
| 698111 | 1/1931 | France | 281/2 |
| 1021151 | 3/1977 | Italy | 229/69 |
| 2095174 | 9/1982 | United Kingdom | 229/92.3 |

*Primary Examiner*—Paul A. Bell
*Assistant Examiner*—Paul M. Heyrana, Sr.
*Attorney, Agent, or Firm*—Browdy and Neimark

[57] ABSTRACT

A module for postal transmission, particularly for confidential information such as bank statements and the like, according to the invention has at least four sections (13, 15, 17, 19; 313, 315, etc.) defined by parallel fold lines (7, 9, 11; 331, 332, etc.) for repeated folding; on one of the external sections (13; 313) of the module, in the fully-folded configuration, a window (F, F1) is provided for the address; the useful face of these sections is surrounded by a perimetrical strip for permanent sealing (23A, 23B, 23C; 623) to assure the inviolability of said face, while on the reverse side of it a non-permanent glueing (25B, 25C; 125B, 125C, etc.) is provided. With respect to the known cross-folding modules, the module of the invention has a larger useful surface available, assures a higher production rate and is more easily handled.

13 Claims, 24 Drawing Figures

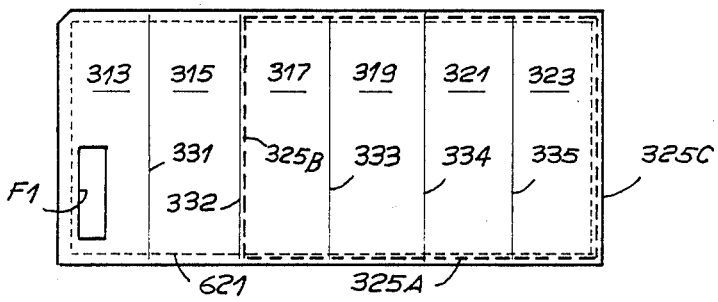
FIG.11
FIG.12
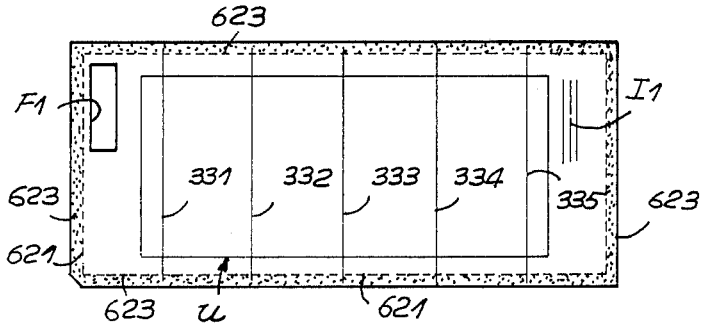
FIG.13
FIG.14
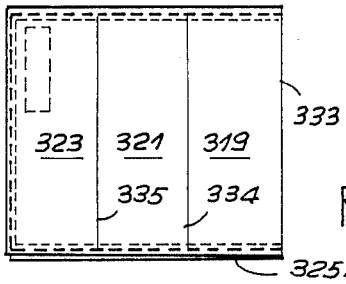
FIG.15
FIG.18
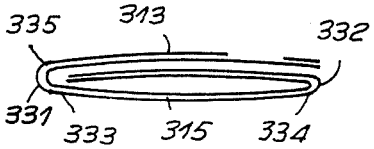
FIG.16
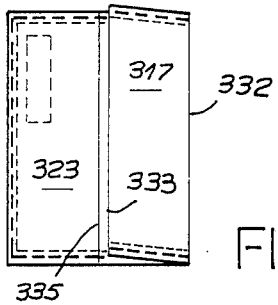
FIG.17
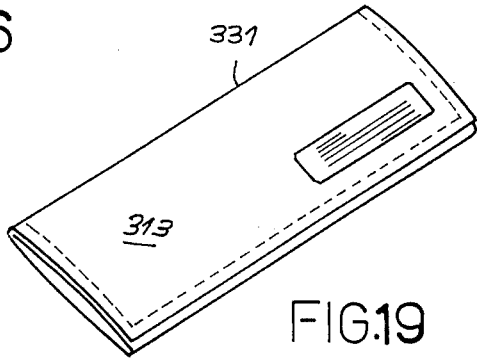
FIG.19

POSTAL MODULE FOR CONFIDENTIAL INFORMATION

The present invention relates to a module for postal transmission which offers a large useful surface and which can be formed from a continuous module; that is, from a sheet of laminar material such as paper, cardboard, or similar materials fit to be passed through a printing device and to be separated into individual modules which can be folded and closed for mailing.

Various types of modules for postal transmission, obtainable from a continuous sheet, are known. Said modules consist in a number of sectors or segments which, when cross-folded one over another and when sealed with differently arranged adhesive strips, for example perimetrical are transformed into closed envelopes. For example, see the module described in Italian Patent No. 1021151 of Mar. 24, 1977. The modules of the type mentioned above are commonly used for billing the users of electrical, telephonic, and similar services by the companies that furnish the relative utilities. This type of module is not, however, suitable for mailing bank statements and similar information for which the inviolability of the enclosure is required because, given their system of folding, they do not provide at the same time sufficient space for said confidential information and the possibility of being adequately sealed. At present, in fact, banks must send their statements to their clients in separate, closed envelopes. This fact determines a considerable loss of time in the case of hand-stuffing, and a considerable investment if automatic stuffing machines are used.

The aim of the present invention is to provide a module for postal transmission obtainable from a continuous strip, suitable for use in sending confidential information, for example bank statements.

The module according to the present invention presents at least four sections delimited by parallel fold lines, and will be folded more than once; one of the external sections of the module, when this last is folded in four, is provided with a window for the address; the useful surface of said sections is surrounded by a perimetrical area for permanent glueing, to assure the inviolability of the useful area; on the reverse side of the useful surface means are provided for non-permanent glueing so that the surfaces of the sections brought into contact with one another by the fold or folds following the first are engaged in such a manner as to be again opened out; means are also provided for cutting three sides of the module in the form it assumes after the first fold, the exception being that side defined by the line of the first fold.

The sections of the module are even in number and the first fold is along a crosswise center line.

Said means for non-permanent glueing extend at least along the end border adjacent to the address and along the fold line that defines the two sections that result external when folding is complete.

The means for non-permanent glueing can be partial non-permanent pre-gummed strips, pre-formed in the continuous module, or applied at the moment of folding, or can be longitudinal areas of non-permanent adhesive applied during folding.

The module according to the present invention offers, with respect to traditional modules, a greater possibility for use of the space on the two faces: in particular, a four-section module offers the following percentages for utilization: space for confidential communication, 50%; space for publicity or non-confidential communication, 25%; space for opening instructions, 12.5%; space for addresses of the sender and the addressee, for postage and postmarks, 12.5%. It also assures a high production rate in the transformation of the continuous strip into sealed modules ready for posting: in fact, it is possible to produce circa 30,000 pieces/hour as opposed to the 6000 pieces/hour obtainable with the traditional stuffing machines and the 15,000 pieces/hour obtainable with cross-fold modules. It should also be taken into consideration that the cost of the machines used for working with the module according to the invention is appreciably lower than that of the machines necessary in the other cases mentioned. Thanks to an adequate disposition of the adhesive on the two faces of the module according to the invention, it does not create problems when the module is used with traditional laser printers. For easy opening, a perimetral perforation, inside the area provided for permanent glueing, is provided. And lastly, it is to be noted that the module according to the invention can be easily filed in normal office fileholders.

The features and the advantages of the module according to the invention will be more clearly revealed in the following descriptions of some non-restrictive embodiments, described by way of example, with reference to the appended drawings, in which:

FIGS. 11 through 19 show different views and the folding sequence for an embodiment with six useful faces;

Figure 1:
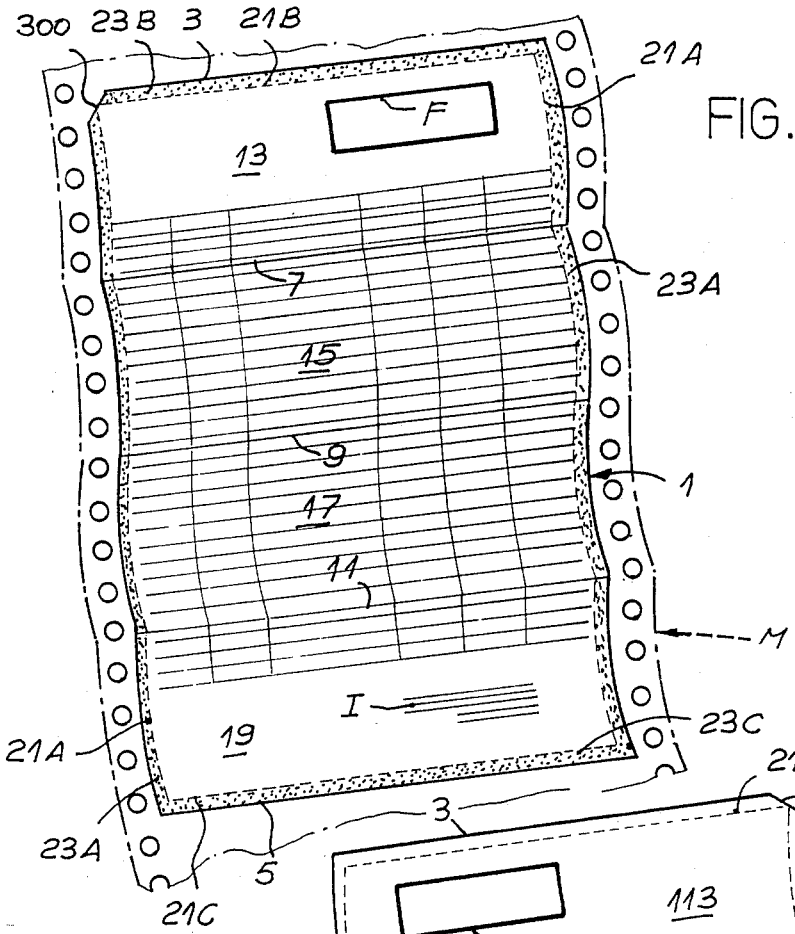
FIGS. 1 and 2 are an inside, front view and a rear plan view of the open module.

According to the illustrations furnished in the appended drawings, and with initial reference to FIGS. 1 through 7, a rectangular module 1 is obtained from a continuous module with a longitudinal perforation along the borders of the strip of material, indicated as M in FIG. 1 with a broken arrow; the continuous module is of the type for automatic compilation and for separation into many separate modules along the transversal lines 3 and 5 which delimit, respectively, the upper and lower borders of the detached modules, as illustrated with a single line in the drawing.

Module 1, once detached from the continuous module, has a relatively large rectangular development (FIGS. 1 and 2) and almost the entire face visible in FIG. 1 can be used for confidential communications, thanks to the sealing system described below. On the useful face an area I is reserved for the address and, in correspondence, a window F is provided; in particular, in the embodiment illustrated, window F is on the upper right and the address I on the lower left; all the rest of the surface can be used for printing or for tabulation or for other elements constituting the contents of the module. The window F can be obtained through treatment of the paper of the module or with punch-cutting and an applied transparent sheet, or better, semi-transparent sheet in order to impede reading in non-correspondent areas or in areas not in direct contact with the sheet covering the window.

Module 1 can be folded along three lines, 7, 9, and 11, which divide the useful part of the module into four areas 13, 15, 17 and 19. The window F is located in zone 13 and the address I in zone 19. The four areas 13, 15, 17 and 19 are substantially equal, and the fold line 9 is central. On the reverse face, areas 113, 115, 117 and 119 correspond to areas 13, 15, 17 and 19.

The useful surface of the module is delimited, peripherically, by perforated lines 21A, 21B and 21C, located slightly inside the perimeter of the open module; between the perforations 21A, 21B and 21C and the perimeter of the module a strip 23A, 23B, 23C is formed and is provided with a gummed surface for permanent sealing: this gumming is distributed along the front useable part 13, 15, 17, 19 of the module. The gummed area, which may coincide wholly or in part with the outer strip 23A, 23B, 23C, is represented by a hatched area in FIG. 1, where it is visible in its entirety. The gumming can also be of the partial-zone type which seals with simple reciprocal contact, or a dry glue to be moistened for sealing, or it may also be composed of any other type of adhesive.

Figure 2:
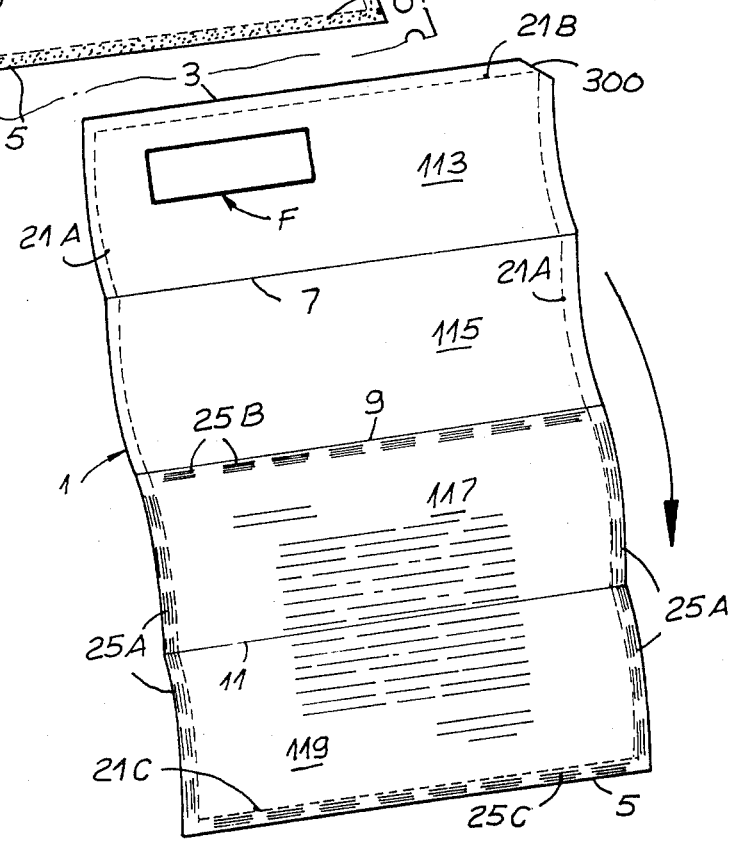
Figure 3:
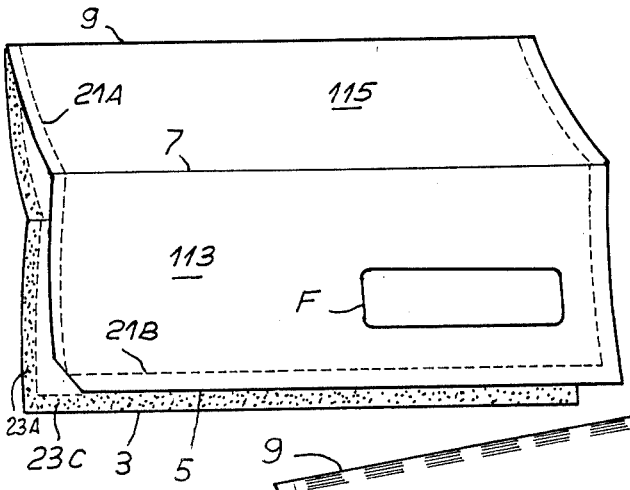
FIGS. 3 and 4 are two essentially opposite views of the partially-folded module.
Figure 4:
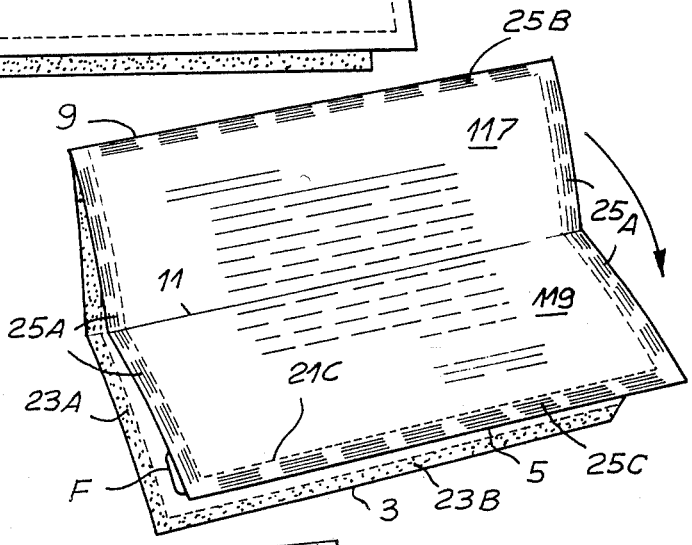
Figure 5:
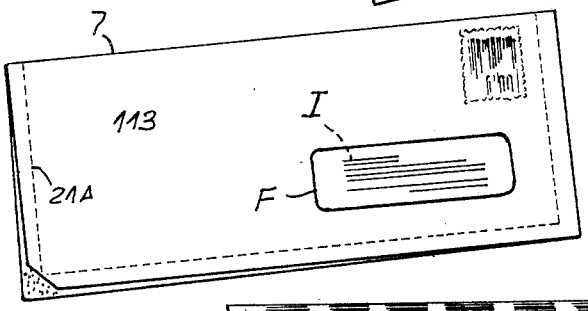
FIG. 5 shows the completely folded and sealed module, ready for mailing.

On the reverse face of the module (with respect to its useful surface) there are gummed areas for detachable (that is, non-permanent) adhesion at least along border 5 with an area 25 and along fold line 9 on part of the section 117 with an area 25B; a permanent or non-permanent glueing may be provided along the longitudinal borders of the module with areas 25A corresponding to sections 117 and 119. These adhesive areas 25A, 25B, 25C are developed as strips which in the drawing are represented by lines of small rectangles; said adhesive areas 25A to 25C may be discontinuous as shown by said small rectangles in the drawing, or may be continuous. FIG. 2 and FIG. 4 show that the adhesive areas 25A, 25C border the top and the two sides of section 117 and that the adhesive areas 25B, 25C border the lower edge and the two sides of section 119. The adhesive on 25A, 25B, 25C may be preformed, or distributed at the time of sealing, or moistened for sealing.

The module, compiled and detached from the material M of the continuous module (automatically or by hand), may be closed and sealed according to the phases described below, which can be carried out in appropriate manners and sequences especially for automatic processing. A first fold along line 9 is made in order to bring sections 13 and 15 of the useful surface against sections 19 and 17 of the same useful surface; the module is thus folded in two and can be permanently sealed by pairing the two adhesive portions 25A, 25C and the two halves of each of the two lateral adhesive portions 23B, which are set against this fold and are symmetrical with respect to line 9; as already noted, the closure becomes permanent and the contents of the module therefore inviolable. The address area I thus comes up against the window F and is the only part of the contents of sections 13, 15, 17, and 19 of the compiled module which is visible without violation of the sealed module. With this fold along line 9 the two halves of the perforations 21A, 21B, 21C also come into contact and are also symmetrical with respect to fold line 9. Fold lines 7 and 11 are now substantially correspondent one to the other. After completing this first operation, consisting in folding the module in two along line 9 (FIGS. 3–4), and after having sealed it with the permanent adhesive strips 23, a second fold is made along fold lines 7 and 11 which now are in correspondence (ca.) one to the other; the fold is made in such a manner as to bring sections 117 and 119 into contact with one another, while areas 113 and 115 remain external. This second operation brings the two non-permanent adhesive portions 25B, 25C, into contact with one another, symmetrically and parallel with respect to fold line 11; the two halves of the lateral adhesive strips 25A are also brought into correspondence. At this point the module is folded in four and closed in such a manner that it can be opened both along line 5 and on the side defined by fold line 9, as well as along the sides of the areas 117 and 119 which are at right angles to border 5 and to line 9 and which are joined at the corresponding sides of areas 15 and 13.

In these conditions (FIG. 5) the module is closed for mailing. It is four layers thick, compact due to the glueing between the corresponding parts of the adhesive areas 25A, 25B, 25C, and shows the address through the window F.

Figure 6:
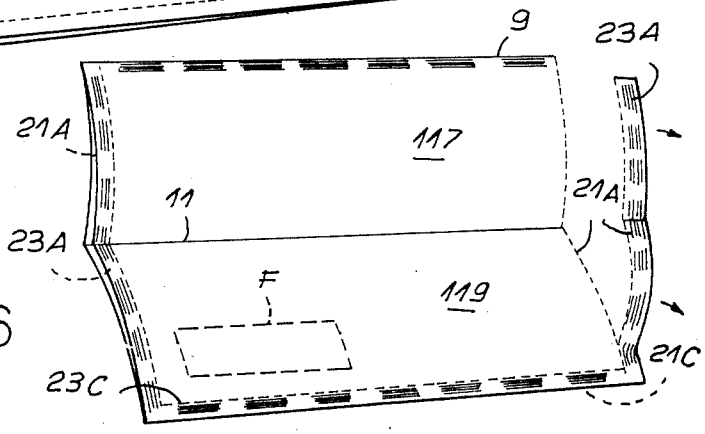
FIG. 6 shows the partially-opened module while it is being torn for opening.

When the module is delivered to destination, the sections 117 and 119 are detached one from the other. In FIG. 6 the adhesive surfaces 25A, 25B, 25C are all non-permanent. In this case the module can be opened out along the closed together fold lines 7 and 11, passing from ca. the configuration shown in FIG. 5 to ca. that of FIG. 4. At this point the module can be torn (see FIG. 6) along the perforated line 21A, 21B, 21C to remove the respective portions of the strip 23 which were permanently glued together with the permanent adhesive; the module is thus opened and areas 13, 15, 17 and 19 can be read, and is in the condition shown in FIG. 1 with the exception of the perimetrical strip 23 which was removed when the three sides of the module were torn along line 21.

Figure 7:
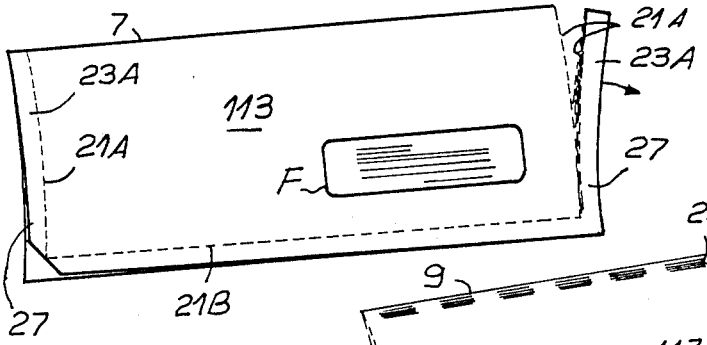
FIGS. 7 and 8 show the module in two phases of partial opening, according to a variant.
Figure 8:
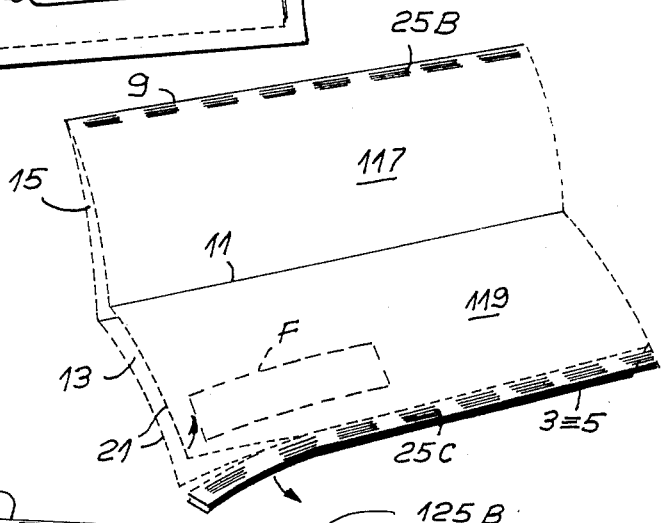

According to the modified embodiment shown in FIGS. 7 and 8, a permanent adhesive along the borders (that is, in the areas 25A) outside of the perforations 21A of the areas 117 and 119, is provided. In this case (see FIG. 7) the module can be opened by removing the fourply lateral strips 27 along the perforation 21A of the four thicknesses of the folded module; the module, which has been cloded in a non-permanent manner along areas 25B, 25C is then opened, to open out areas 117 and 119 along fold lines 7 and 11; finally strips 23B, 23C along the sealed borders are removed and the module is opened out along fold line 9.

Figure 9:
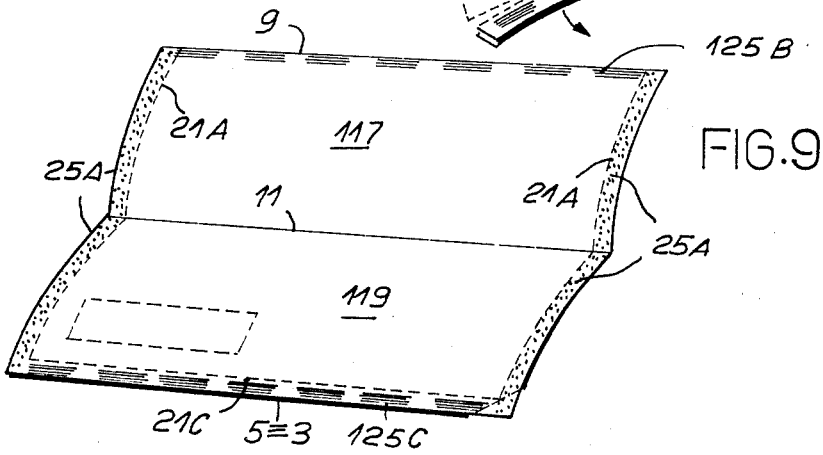
FIGS. 9 and 10 show other variants.
Figure 10:
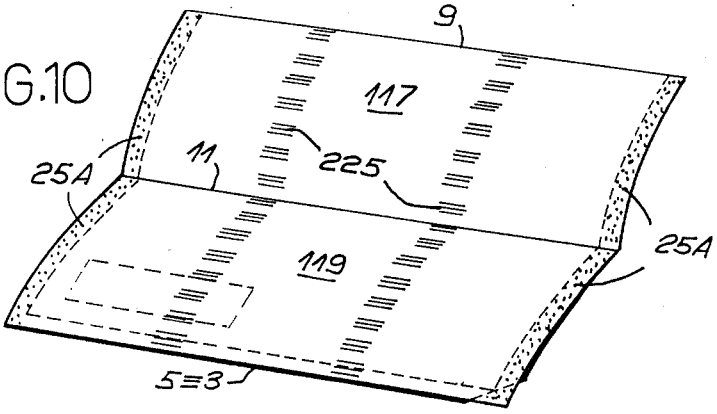
Figure 20:
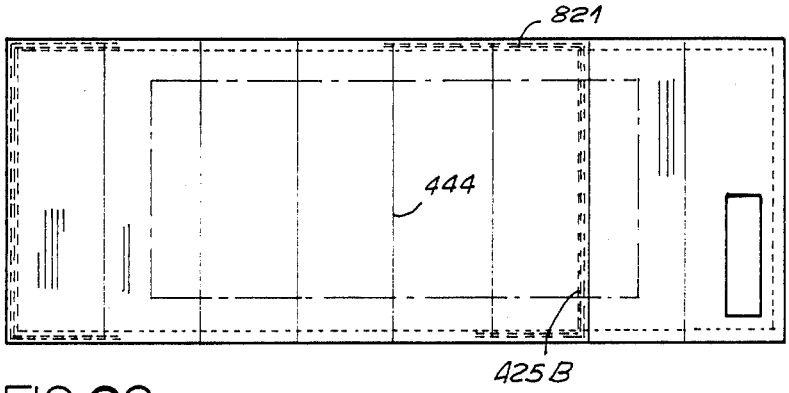
FIGS. 20 through 24 show an embodiment with eight useful faces, in the various phases of folding.
Figure 21:
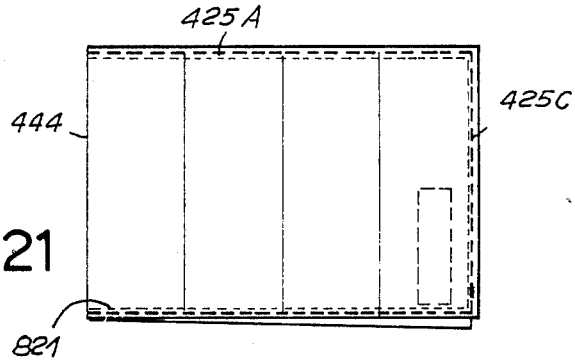
Figure 22:
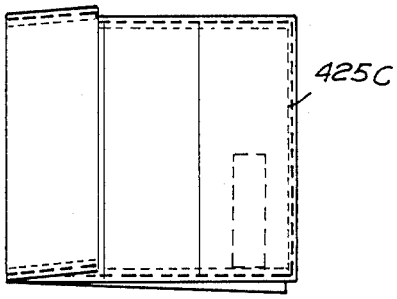
Figure 24:
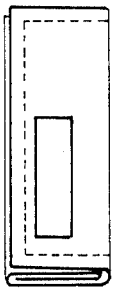
Figure 23:
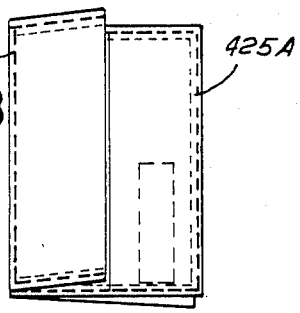

According to another variation of the embodiments heretofore described, the features of which are illustrated in FIGS. 9 and 10, the pre-formed non-permanent adhesive strips 25B and 25C can be eliminated in order to eliminate the adhesive on the back of the useful width of the module, which is (circa) that delimited by perforations 21A; in this manner the possible inconveniences to the printer that could be caused by the presence of adhesive on the reverse side are avoided. If this variant is used, the two areas 117 and 119 may be left open along borders 9 and 5 (while they remain connected laterally along adhesive strips 25C and along fold line 11); or non-permanent glueing may be used, formed extemporaneously during folding, like those adhesive patterns with intermittent distribution 125B, 125C (FIG. 9) along fold 9 and borders 3–5 (instead of the pre-gummed strips 25B, 25C); or longitudinal continuous distribution strips 225 (FIG. 10) which assure closure at different points along borders 9 and 5, again with non-permanent adhesive, may be used. In all cases in this manner the risk of soiling the printer is avoided, a risk that is never posed by the lateral adhesive strips such as 25A, which can be pre-formed.

It is worthwhile noting that the module ready for mailing is completely sealed and four times the thickness of the paper from which it is made; moreover the "horizontal" borders (fold line 7 and borders 3 and 5); that is, the long sides of the module ready for mailing are robust and not weakened by the perforation 21 (which is present only in two thicknesses and only along the lower edge (3–5 in FIG. 5), that which is required for handling with the automatic sorting machines used by the postal administrations. Inviolability is assured—as already noted—by the permanent adhesive strips 23A, 23B, 23C. The useful and inviolable surface of the module is in practice four times the dimensions of the module ready for mailing.

Closure of the module is rapid, in that the folds and sealing are realized without ever having to turn the module 90°, since the folds are parallel.

For easing opening out sections 117 and 119, and that is the removal of the non-permanent adhesive strip 25, the removal of at least one corner, indicated as 300, and/or the interruption of the adhesive in correspondence to at least one corner, may be provided for.

A module as described above could also be lengthened with other useful areas in addition to 13, 15, 17, 19, as a prolungation past border 5. In this case the said other areas are folded inside those denominated 13, 15, 17, 19, or accordion-folded, or folded in another manner, and provided with adhesive sealing strips or made with a format reduced with respect to that of the primary areas, particularly in width, so that they remain within the delimitation of the lateral perforations 21.

FIGS. 11 through 19 show an embodiment with six useful sections 313, 315, 317, 319, 321, 323, delimited by fold lines 331, 332, 333, 334, 335, and with a window F1, address area I1, and a useful area U (FIG. 13). On the reverse face (FIG. 11) of the useful area U the areas 317, 319, 321, 323 are surrounded by adhesive strips 325A, 325B, 325C, analogous to those denominated 25A, 25B, 25C above, or by strips arranged in a manner analogous to that described for the variants previously considered. The module will have a perimetral perforation 621 analogous to that denominated 21 and a permanent perimetrical adhesive strip 623. The procedures for use are analogous to those for the four-section embodiments. After the useful area U has been printed, the module is folded along the central fold line 333 (FIGS. 14–15) and the two overlapping portions of the permanent adhesive strip 623 are glued together perimetrically around the useful face. The module is then folded along lines 332, 334 to obtain the configuration shown in FIGS. 18 and 19. To open, proceed inversely to the sequence illustrated, that is, FIGS. 16–17 and FIGS. 14–15 when the adhesive strips 325A, 325B, 325C are of the non-permanent type, or by first removing the lateral borders and then opening the module and detaching the adhesive strips 325B, 325C, which must in any case be non-permanent. Then complete opening by removing the adhesive strips at the extreme edges of the areas 313 and 323 to open the module from the configuration shown in FIGS. 14 and 15 to that shown in FIGS. 11 and 13, using perforations 621.

FIGS. 20 through 24 show another variant, in which the module is composed of 8 sections. In this case as well, folding is carried out along the central fold line 444 in order to seal the module (FIG. 21) along the perimeter with permanent adhesive applied around the useful area and around the perimetrical perforation 821. Non-permanent adhesive strips 425A, 425B, 425C are provided on the reverse face of the useful area; their function is equivalent to that of the adhesive strips 25A, 25B and 25C. Folding follows the sequence illustrated in FIGS. 21 through 24; opening in inverse sequence.

It is clear that the variants hereinbefore described for the four-section module may be applied also to the examples given in FIGS. 11 through 24, with no further need of explanation.

It is understood that the drawing shows only some embodiments, given only as a practical demonstration of the invention, and that various changes or modifications may be made in the forms and designs within the scope of the invention without departing from the scope thereof. The inclusion of reference numbers in the hereunto appended claims aims at making reading of the claims easier by providing reference to the description and to the drawing, and does not in any way limit the compass of protection represented by the claims. For example, the perforated lines 21, 621, 821 may be substituted by lines indicating where to cut with scissors or letter openers.

I claim:

1. A postal module, of the foldable and sealable type, separable from a continuous strip of modules suitable to be passed through a printer and then through a cutting unit in which individual modules are separated from the strip comprising:

a sheet having longitudinal and transverse axes of symmetry and including at least four substantially equal sections delimited by corresponding, preformed, parallel fold lines, said sections having a front face, usable for reporting confidential information, and back face, one of said fold lines corresponding to the transverse axis of symmetry of said sheet and facilitating a first fold in which the front faces of said sections are disposable adjacent each other, the section delimited by one end of the sheet and the closest fold line parallel to it being provided with a window for visualizing an address correspondingly printed on the front face of a symmetrically disposed section delimited by an opposite end of the sheet and the closet fold line, the remaining fold lines facilitating at least one further fold of the sheet in which the back faces of two adjacent sections are disposed adjacent to each other, the section with said window being kept visible on the folded sheet;

permanent sealing means provided on a perimetrical band of said face usable for reporting information for securing the inviolability thereof;

non-permanent glueing means provided on the back face of the sections to be disposed against each other so as to allow opening of the sheet for control;

and tearing means provided along said perimetrical band for complete opening of the sheet following its mailing and receipt.

2. A module according to claim 1, wherein the single sheet separated from the continuous strip is composed of four sections defined by three parallel fold lines, to be folded in two with a first folding operation, and sealed, and then in two again with a second folding operation to obtain four thicknesses.

3. A module according to claim 1, wherein the single sheet separated from the continuous strip is composed of six sections which can be folded along a transversal center line and which is sealed perimetrically along a border strip of permanent adhesive which surrounds the useful area, the sheet thus folded in two being then refolded twice again.

4. A module according to claim 1, wherein the single sheet separated from the continuous strip is made up of eight sections which can be folded in two along a central transversal line and sealed along the perimeters with a permanent adhesive strip which surrounds the useful area, the strip thus folded in two being afterwards re-folded another three times.

5. A module according to claim 1, wherein said sections are even in number.

6. A module according to claim 1, wherein said non-permanent glueing means are provided at least along one end of the section on which the address is printed and along the fold line parallel to said side designed to be put in correspondance with it after said at least one further fold.

7. A module according to claim 6, wherein said non-permanent glueing means along said end and said fold line consists of discontinuous pregummed bands preformed on the continuous strip of modules parallel with said transverse axis of symmetry.

8. A module according to claim 6, wherein said non-permanent glueing means consists of gummed bands applied transversely on the sheet during the fold operation.

9. A module according to claim 6, wherein said non-permanent glueing means are further provided along the longitudinal sides of the sections which are disposed adjacent each other at the end of said at least further fold operation.

10. A module according to claim 1, wherein permanent adhesive is provided on longitudinal tearing strips which are removed when opening the sheet itself.

11. A module according to claim 1, wherein said window is obtainable by direct treatment of the sheet.

12. A module according to claim 1, wherein said window comprises a film of at least semi-transparent material secured to said sheet.

13. Postal modules carried contiguously by a continuous strip adapted to be passed in one direction successively through automatic machinery including a printing means, a cutting means, a folding means and a sealing means, said postal modules each comprising:

first and second ends, and sides extending between said ends in said one direction, a front face adapted to display information printed thereon by said printing means and a back face, a predetermined length adapted to be cut from said strip by said cutting means, a first axis of symmetry parallel to said one direction and a second axis of symmetry disposed transversely of said first axis, a first preformed fold line formed at said second axis and at least one additional preformed fold line formed equidistantly between said first fold line and each of said first and second ends, whereby said fold lines delimit therebetween at least four substantially equal sections, one of said sections between one of said first or second ends and the fold line closest thereto including a window for viewing an address printed by said printing means on the section located between the other of said first or second ends and the fold line located closest thereto, said first fold line facilitating a first fold of said module by said folding means after said module has been cut from said strip in which the front faces of said sections are disposed adjacent each other, and said additional fold lines facilitating at least one further fold of said folded module by said folding means in which the back faces of two adjacent sections are disposed adjacent to each other, permanent sealing means disposed in a perimetrical band about said front face for sealing facing adjacent sections by said sealing means after said first fold is carried out by said folding means, non-permanent glueing means provided in a perimetrical band on the back face of said two adjacent sections whereby said two adjacent sections may be opened after being sealed by said sealing means, and tearing means provided along said perimetrical band inwardly of said sides and the included end for completely opening said module following its mailing and receipt.

* * * * *